US005292408A

United States Patent [19]

Tanigawa et al.

[11] Patent Number: 5,292,408

[45] Date of Patent: Mar. 8, 1994

[54] PITCH-BASED HIGH-MODULUS CARBON FIBERS AND METHOD OF PRODUCING SAME

[75] Inventors: Eiji Tanigawa, Izumiotsu; Takemi Nakamura, Kyoto; Takayuki Mine, Nara, all of Japan

[73] Assignees: Osaka Gas Company Limited; Dainippon Ink and Chemicals, Incorporated, both of Japan

[21] Appl. No.: 737,608

[22] Filed: Jul. 25, 1991

Related U.S. Application Data

[63] Continuation of Ser. No. 540,164, Jun. 19, 1990, abandoned.

[51] Int. Cl.[5] ..... D01F 11/10

[52] U.S. Cl. ..... 204/129.1; 204/130; 423/447.1; 423/447.6; 423/447.7; 423/447.8

[58] Field of Search ..... 423/460, 447.7, 447.8, 423/447.6, 447.1; 264/29.2, 29.5; 204/129.1, 130

[56] References Cited

U.S. PATENT DOCUMENTS

| | | | |
|---|---|---|---|
| 3,894,884 | 7/1975 | Druin et al. | 423/460 |
| 4,009,305 | 2/1977 | Fujimaki et al. | 423/447.1 |
| 4,356,158 | 10/1982 | Ishikawa et al. | 423/447.4 |
| 4,411,880 | 10/1983 | Brogna | 423/460 |
| 4,610,860 | 9/1986 | Mullen | 423/447.8 |
| 4,814,157 | 3/1989 | Uno et al. | 423/460 |
| 5,037,697 | 8/1991 | Fujisawa et al. | 264/29.2 |

FOREIGN PATENT DOCUMENTS

| | | | |
|---|---|---|---|
| 1-104879 | 4/1989 | Japan | 423/460 |
| 1180441 | 2/1970 | United Kingdom | 423/460 |

*Primary Examiner*—Wayne Langel
*Assistant Examiner*—Stuart L. Hendrickson
*Attorney, Agent, or Firm*—Larson and Taylor

[57] ABSTRACT

The present invention provides an improvement in the process of producing pitch-based carbon fibers comprising the steps of spinning a spinnable pitch, treating the resulting pitch fibers for rendering infusible, and carbonizing the same, the improvement comprises the step of removing the surface layer from the carbon fibers obtained in said process.

7 Claims, 2 Drawing Sheets

PITCH-BASED HIGH-MODULUS CARBON FIBERS AND METHOD OF PRODUCING SAME

This application is a continuation of U.S. application Ser. No. 07/540,164 filed Jun. 19, 1990 now abandoned.

FIELD OF THE INVENTION

This invention relates to pitch-based high-modulus carbon fibers and a method of producing the same.

Fibers made from pitch fibers by carbonization at a temperature not higher than about 1,500° C. are called "carbon fibers" while fibers produced by carbonization at a temperature of about 1,500° C. or higher are sometimes called "graphite fibers" whether they have the crystal structure of graphite or not. However, the carbonization temperature for making a distinction between carbon fibers and graphite fibers is not distinctly defined even in the relevant art. It is to be noted that "carbon fibers" so called in this specification include not only carbon fibers but also graphite fibers obtained by carbonization of pitch fibers.

BACKGROUND OF THE INVENTION

Pitch-based carbon fibers have a higher elastic modulus than PAN (polyacrylonitrile)-based carbon fibers, and therefore, are used in making composite materials based on plastics, metals, carbon, ceramics and so forth. Furthermore, it is expected that they will find a wider field for applications, for example as lightweight structural materials or heat-resistant materials for use in aircraft, spacecraft and equipment, automobiles and the like.

A method of producing pitch-based high-modulus carbon fibers is disclosed, for example, in Japanese Kokai Tokkyo Koho No. 120112/1988. The method disclosed in the above-cited publication is characterized by reducing, in rendering spun pitch fibers infusible (stabilization), the thickness of the infusible layer to thereby suppress the formation, in the product carbon fibers, of a surface layer with a low Young's modulus. In this method, however, the thickness of the infusible layer may occasionally become insufficient, so that fusion may occur in the step of carbonization.

Another method proposed for increasing the modulus of carbon fibers comprises carrying out the heat treatment for carbonization, which follows treatment for rendering pitch fibers infusible, at an increased temperature. However, this method is disadvantageous in that the yield is low and in that the physical properties of the product carbon fibers, such as tensile strength and elongation percentage, tend to decrease.

SUMMARY OF THE INVENTION

As a result of their intensive investigations made in an attempt to overcome the problems in the prior art, such as mentioned above, the present inventors have found that removal of the surface layer from the carbon fibers produced by the conventional process comprising spinning pitch, rendering the resulting pitch fibers infusible and carbonizing the same results in a marked improvement in modulus of elasticity.

Thus the invention provides: a method of producing pitch-based high-modulus carbon fibers which comprises removing the surface layer from the carbon fibers produced by spinning a spinnable pitch species, rendering the pitch fibers infusible and carbonizing the same; and pitch-based high-modulus carbon fibers comprising a layer substantially uniform in modulus of elasticity.

DETAILED DESCRIPTION OF THE INVENTION

Referring to the accompanying drawings, the invention is now described in further detail.

Figure 1:
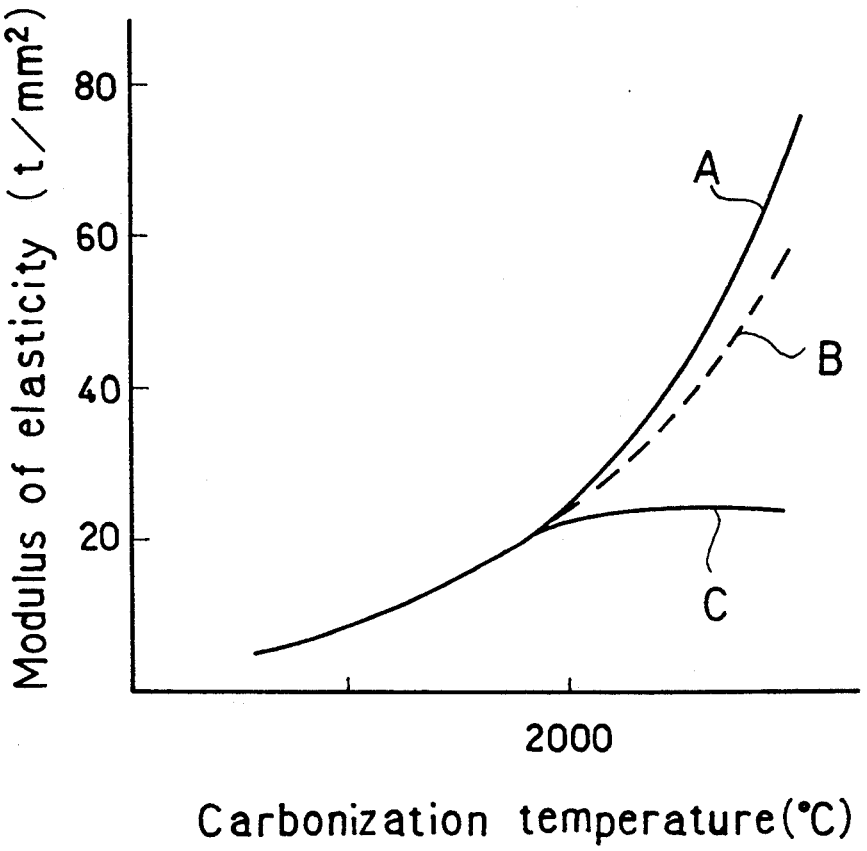
FIG. 1 is a schematic and graphic representation of the relationship between carbonization temperature and modulus of elasticity of carbon fibers.

In the production of carbon fibers, the modulus of elasticity of fibers generally increases with increasing carbonization temperatures. The relationship between carbonization temperature and modulus of elasticity of carbon fibers is schematically shown in FIG. 1. As shown by curve A, the elastic modulus of the core portion of carbon fibers rapidly increases with the increase of carbonization temperature whereas the modulus of the surface layer cannot exceed 25–30 tonf/mm$^2$, as shown by curve C, hence the modulus of each carbon fiber as a whole increases only in a relatively gentle manner, as shown by curve B.

Figure 2:
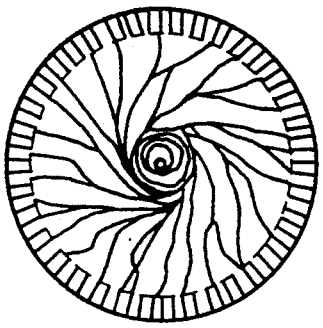
FIG. 2 is a schematic representation, in section, of a carbon fiber produced by the conventional method.
Figure 3:
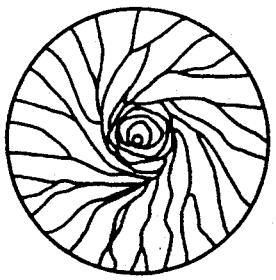
FIG. 3 is a schematic representation, in section, of a carbon fiber deprived of the surface layer thereof in accordance with the invention.

In the surface layer, the orientation of crystals is disturbed as a result of introduction of oxygen in the step of rendering pitch fibers infusible (stabilization) and elimination of carbon in the carbonization step, among others. This is presumably a main factor causing decreases in modulus of carbon fibers. FIG. 2 schematically shows the section of a carbon fiber produced in the conventional manner by carbonizing a pitch fiber at about 2,000° C. following the step of rendering it infusible. In this conventional carbon fiber, there is a surface layer having a relatively low modulus due to various effects produced in the step of stabilization. As can be seen in FIG. 3, removal of such surface layer in accordance with the invention leads to elimination of the modulus-decreasing factor and formation of a layer uniform in modulus of elasticity all over the fiber cross-section, resulting in an increased modulus of the carbon fibers. The present invention has been completed on the basis of such novel findings.

The method of the invention can be applied to any pitch-based carbon fiber irrespective of raw material pitch, production method, fiber shape, fiber structure, etc. Thus, for example, raw material pitches which are usable include coal tar pitch, petroleum pitch, and synthetic pitch such as polymers of naphthalene, anthracene, tetrabenzophenazine, etc. For producing high modulus carbon fibers in accordance with the invention, the pitch preferably has a mesophase content of not less than 70%, more preferably not less than 85%. In the steps of spinning, stabilization, carbonization, etc., any known techniques may be applied. Thus, for example, the step of stabilization (rendering pitch fibers infusible) may be carried out using air, an oxygen-containing gas under pressure, nitric acid, a NOx-containing gas, etc. Among the stabilization means mentioned above, nitric acid and NOx are most effective. As regards the ultrastructure and configuration of the carbon fiber cross section as well, the method of the invention can be applied to every structure, for example radial, random, onion, or multilayer structure, and to every configuration or shape, for example circular or modified (e.g. elliptical) cross section.

It is preferable that the infusible (stabilized) fibers obtained be carbonized at a very high temperature (e.g. about 2,000° C.) so that the surface layer thereof adversely influenced in the step of stabilization can be eliminated. It is also possible to eliminate, in the manner mentioned below, the surface layer from carbon fibers obtained by carbonizing at a relatively low temperature (e.g. about 1,000° C.) and subject the fibers to further heat treatment at a higher temperature (e.g. about 2,000° C.). In this way, carbon fibers with a higher modulus (not less than 70 tonf/mm$^2$) can be obtained since the surface layer influenced in the stabilization step has already been removed and therefore the modulus of elasticity is uniform all over the carbon fiber cross section and since the modulus further increases upon said further heat treatment.

For eliminating the carbon fiber surface layer, gaseous phase oxidation, electrolytic oxidation and chemical oxidation and the like can be employed. The thickness of the surface layer to be eliminated may vary depending on the carbon fiber diameter, production conditions and other factors. Generally, however, said thickness is about 2–20%, preferably about 10–15%, of the diameter of carbon fibers. Irrespective of the means of oxidation selected from among those mentioned above, the conditions of oxidative treatment, in particular the treatment temperature and period, should preferably be selected so that the surface layer can be removed to a depth necessary for achieving a desired extent of improvement in modulus.

The gaseous phase oxidation can be effected by heating carbon fibers in an oxidizing atmosphere (e.g. air) generally at a temperature of about 700–1,100° C. for about 0.1–60 seconds.

The electrolytic oxidation can be effected, for example by placing carbon fibers in an electrolysis solution, for example sulfuric acid, sodium hydroxide solution, etc. and conducting electrolysis using such a metal as titanium, platinum etc. as the cathode and carbon fibers as the anode.

The chemical oxidation can be effected by immersing carbon fibers in nitric acid or some other appropriate solution.

EFFECTS OF THE INVENTION

In accordance with the invention, markedly improved effects can be produced as follows:

(1) Products with a high modulus comparable to that of the conventional products can be obtained at a lower carbonization temperature as compared with the known processes and, therefore, marked cost reduction can be attained in view of the life of carbonization furnaces, operation cost, etc.

(2) Products with a high modulus of not less than 70 tonf/mm$^2$ can be produced as well in a relatively easy and stable manner.

(3) Carbon fibers uniform in modulus all over the fiber cross section can be obtained.

(4) Carbon fibers superior in resistance to thermal oxidation (heat stability) to the conventional products can be obtained.

(5) High modulus carbon fibers provided by the invention, which are homogeneous and superior in heat resistance, are useful as materials for producing metal composites with aluminum, resin composites with epoxy and other resins and C/C composites, for instance. These composite materials containing carbon fibers provided by the invention are useful in a wide field where lightweight properties, high rigidity, thermal stability during processing and use, good thermal conductivity and electrical conductivity and other properties are required, for example the fields of space craft and equipment, aircraft, various vehicles, sports goods, industrial equipment, etc.

EXAMPLES

The following examples are further illustrative of the features of the invention.

EXAMPLE 1

A pitch suited for spinning (with an optically anisotropic phase content of not less than 85% and a softening point of 300°–320° C.) was spun into fibers at 345°–360° C. using a melt spinning machine with a nozzle diameter of 0.15 mm. The pitch fibers obtained were rendered infusible by a conventional method and then carbonized at 2,800° C. to give carbon fibers.

The thus-obtained carbon fibers had a modulus of 55 tonf/mm$^2$, a tensile strength of 274 kgf/mm$^2$ and a fiber diameter of 8.8 μm.

These fibers were heated in air at 1,000°–1,100° C. for about 15 seconds for removing the surface layer through gaseous phase oxidation.

The carbon fibers after gaseous phase oxidation had a modulus of 65 tonf/mm$^2$ (increase by 18%), a tensile strength of 272 kgf/mm$^2$ and a fiber diameter of 7.7 μm.

EXAMPLE 2

Pitch fibers prepared as described in Example 1 were rendered infusible and then carbonized at 2,700° C.

The thus-obtained carbon fibers had a modulus of 50 tonf/mm$^2$, a tensile strength of 274 kgf/mm$^2$ and a diameter of 9.0 μm.

These carbon fibers were subjected to oxidation treatment in the same manner as in Example 1 to give fibers with the following physical properties: a modulus of 60 tonf/mm$^2$ (increase by 20%) and a tensile strength of 271 kgf/mm$^2$. The fiber diameter was 8.0 μm.

EXAMPLE 3

Pitch fibers prepared as described in Example 1 were rendered infusible and then carbonized at 2,600° C.

The thus-obtained carbon fibers had a modulus of 45 tonf/mm$^2$, a tensile strength of 250 kgf/mm$^2$ and a diameter of 9.4 μm.

These carbon fibers were subjected to oxidation treatment in the same manner as in Example 1 to give fibers with the following physical properties: a modulus of 50 tonf/mm$^2$ (increase by 11%) and a tensile strength of 251 kgf/mm$^2$. The fiber diameter was 8.4 μm.

EXAMPLE 4

Pitch fibers prepared as described in Example 1 were rendered infusible and then carbonized at 2,950° C.

The thus-obtained carbon fibers had a modulus of 69 tonf/mm$^2$, a tensile strength of 265 kgf/mm$^2$ and a diameter of 8.7 μm.

These carbon fibers were subjected to oxidation treatment in the same manner as in Example 1 to give fibers with the following physical properties: a modulus of 84 tonf/mm$^2$ (increase by 22%) and a tensile strength of 260 kgf/mm$^2$. The fiber diameter was 7.7 μm.

EXAMPLE 5

Pitch fibers prepared as described in Example 1 were immersed in 15 weight percent nitric acid, then rendered infusible by heating at 380° C. for 10 minutes, and carbonized at 2,700° C.

The thus-obtained carbon fibers had a modulus of 47 tonf/mm$^2$, a tensile strength of 290 kgf/mm$^2$ and a diameter of 9.1 μm.

These carbon fibers were subjected to oxidation treatment in the same manner as in Example 1 to give fibers with the following physical properties: a modulus of 61 tonf/mm$^2$ (increase by 28%) and a tensile strength of 285 kgf/mm$^2$. The fiber diameter was 8.2 μm.

EXAMPLE 6

A synthetic pitch mainly consisting of naphthalene polymers (with an optically anisotropic phase content of not less than 80% and a softening point of 260°-280° C.) was spun into fibers at 290°-330° C. using a melt spinning machine with a nozzle diameter of 0.15 mm. The pitch fibers obtained were then treated in air containing 2% of NO2 at 350° C. for 25 minutes for rendering the fibers infusible and carbonized at 2,500° C.

The thus-obtained carbon fibers had a modulus of 59 tonf/mm$^2$, a tensile strength of 302 kgf/mm$^2$ and a diameter of 8.5 μm.

These carbon fibers were subjected to oxidation treatment by heating in air at 950°-1,050° C. for 25 seconds to give fibers with the following physical properties: a modulus of 75 tonf/mm$^2$ (increase by 27%) and a tensile strength of 294 kgf/mm$^2$. The fiber diameter was 7.4 μm.

We claim:

1. In the process of producing optically anisotropic pitch-based carbon fibers which comprises spinning a spinnable pitch containing an optically anisotropic component, treating the resulting pitch fibers to render the fibers infusible, and carbonizing same, the improvement comprising producing carbon fibers having higher modulus than the carbon fibers obtained in said process by removing the surface layer of low modulus of elasticity from the carbon fibers obtained in the said process.

2. The process of claim 1, wherein the removal of the carbon fiber surface layer is effected by oxidation.

3. The process of claim 2, wherein the oxidation is gaseous phase oxidation.

4. A method of producing pitch-based high-modulus carbon fibers, the improvement of which further comprises recarbonizing the carbon fibers deprived of the surface layer of low modulus of elasticity thereof by the method of claim 1 at a temperature higher than the initial carbonization temperature.

5. The process of claim 1, wherein the pitch fibers are rendered infusible by the use of nitric acid or nitrogen oxides.

6. The process of claim 2 wherein the oxidation is electrolytic oxidation.

7. The process of claim 2 wherein the oxidation is chemical oxidation.

* * * * *